US007000911B2

(12) United States Patent
McCormick et al.

(10) Patent No.: US 7,000,911 B2
(45) Date of Patent: Feb. 21, 2006

(54) MOTOR PACK FOR AUTOMATED MACHINERY

(75) Inventors: Peter E. McCormick, Dallas, TX (US); Daniel Alan Beall, Allen, TX (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/788,142

(22) Filed: Feb. 26, 2004

(65) Prior Publication Data

US 2004/0231870 A1 Nov. 25, 2004

Related U.S. Application Data

(63) Continuation-in-part of application No. 10/640,200, filed on Aug. 13, 2003, which is a continuation of application No. 10/321,880, filed on Dec. 17, 2002, now Pat. No. 6,644,638, which is a continuation-in-part of application No. 09/887,293, filed on Jun. 22, 2001, now Pat. No. 6,585,246.

(51) Int. Cl.
*B25B 1/04* (2006.01)

(52) U.S. Cl. ..... 269/239; 269/32; 269/20

(58) Field of Classification Search ..... 269/32, 269/20, 228, 24–27, 225
See application file for complete search history.

(56) References Cited

U.S. PATENT DOCUMENTS

| | | | | |
|---|---|---|---|---|
| 4,770,401 | A * | 9/1988 | Donaldson | 269/249 |
| 5,912,541 | A | 6/1999 | Bigler et al. | |
| 6,655,673 | B2 * | 12/2003 | Colby | 269/32 |
| 2002/0190455 | A1 * | 12/2002 | Sawdon | 269/32 |

* cited by examiner

*Primary Examiner*—Lee D. Wilson
(74) *Attorney, Agent, or Firm*—Brian F. Russell; Dillon & Yudell LLP

(57) ABSTRACT

A motor pack for an electrically driven tool includes at least one electric motor and a linearly displaceable member coupled to the electric motor such that the linearly displaceable member is displaced axially by operation of the at least one electric motor. The motor pack further includes a housing enclosing the electric motor and at least partially enclosing the linearly displaceable member. The housing includes a front plate to which a tool head may be removably coupled. The front plate has an aperture formed therein through which the linearly displaceable element can be coupled to a moveable element in the tool head. The motor pack also includes tool control circuitry enclosed within the housing and electrically coupled to the electric motor to control operation thereof.

19 Claims, 14 Drawing Sheets

Fig. 8
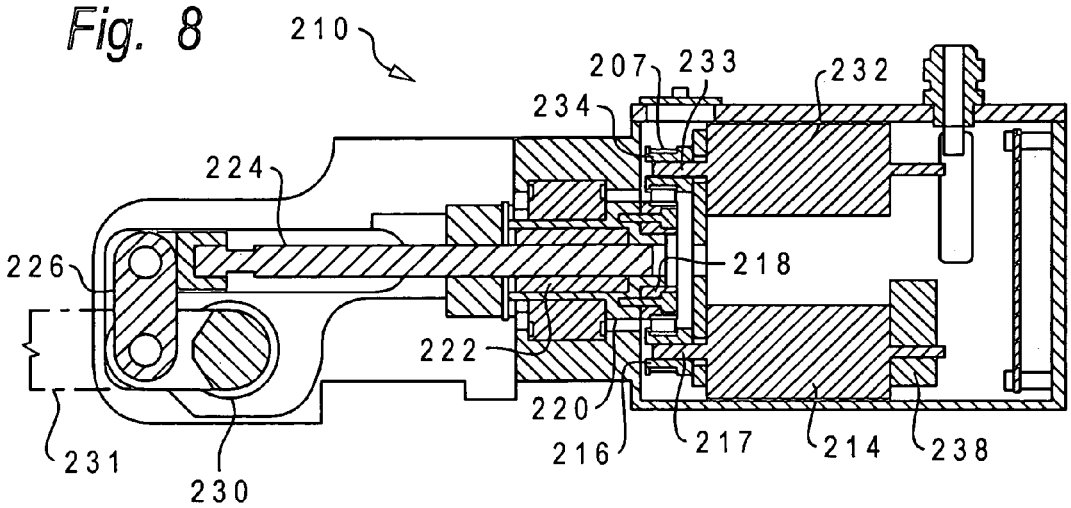
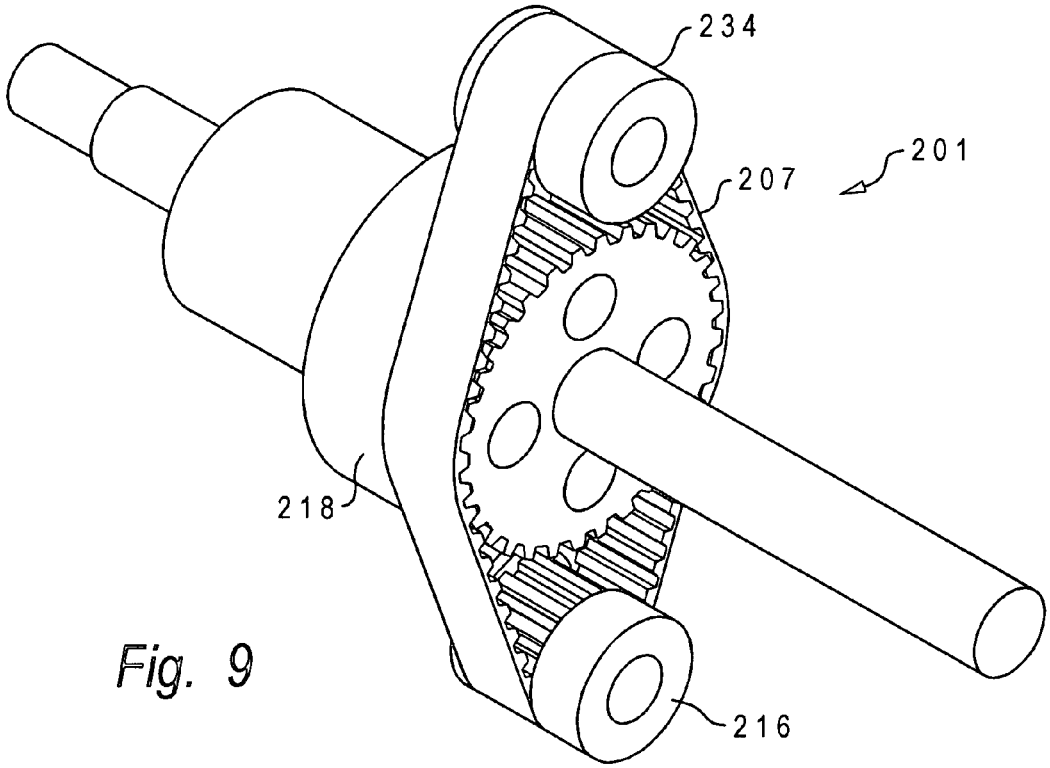
Fig. 9

MOTOR PACK FOR AUTOMATED MACHINERY

The present application is a continuation-in-part of U.S. patent application Ser. No. 10/640,200, filed Aug. 13, 2003, which is a continuation of U.S. patent application Ser. No. 10/321,880 filed on Dec. 17, 2002, now U.S. Pat. No. 6,644,638, which is a continuation-in-part of U.S. patent application Ser. No. 09/887,293 filed on Jun. 22, 2001, now U.S. Pat. No. 6,585,246. All of the foregoing applications are incorporated herein by reference in their entireties.

BACKGROUND OF THE INVENTION

1. Technical Field

This invention is related to motor-driven machinery and tools, and in particular, to a motor pack for motor-driven tools.

2. Description of the Related Art

The robotics and automation industry employs a number of tools, such as clamps, pin clamps, hook pin clamps and grippers, to secure, manipulate and/or transport objects, for example, components of an assembly. Although electrically powered tools are generally more quiet than pneumatically powered tools and advantageously eliminate the need to route air hoses to various assembly stations at a manufacturing facility, the majority of tools currently used in the automation industry are still pneumatically powered. The predominance of pneumatically powered tools is primarily attributable to the significantly greater power that can be obtained from a pneumatically powered tool compared with conventional electrically powered tools of similar size.

Because of recent advances in the performance of electrical tools, such as those disclosed in the above-referenced applications, electrically powered tools are gaining greater acceptance in industry. However, the complexity of conventional control systems for electrically powered tools is a significant disadvantage that has retarded the adoption of electrically powered tools in the automation industry.

SUMMARY OF THE INVENTION

In view of the foregoing, the present invention provides a motor pack for an electrically driven tool. The motor pack includes at least one electric motor and a linearly displaceable member coupled to the electric motor such that the linearly displaceable member is displaced axially by operation of the at least one electric motor. The motor pack further includes a housing enclosing the electric motor and at least partially enclosing the linearly displaceable member. The housing includes a front plate to which a tool head may be removably coupled. The front plate has an aperture formed therein through which the linearly displaceable element can be coupled to a moveable element in the tool head. The motor pack also includes tool control circuitry enclosed within the housing and electrically coupled to the electric motor to control operation thereof.

All objects, features and advantages of the present invention will become apparent from the following detailed description.

BRIEF DESCRIPTION OF THE DRAWINGS

So that the manner in which the described features, advantages and objects of the invention, as well as others which will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

FIG. 8 is a side view of an electric clamp constructed in accordance with a second embodiment of the present invention showing the clamp in its clamped position.

FIG. 9 is a partial isometric view of a drive system of the electric clamp of FIG. 8.

DETAILED DESCRIPTION OF THE PREFERRED EMBODIMENT

Figure 1:
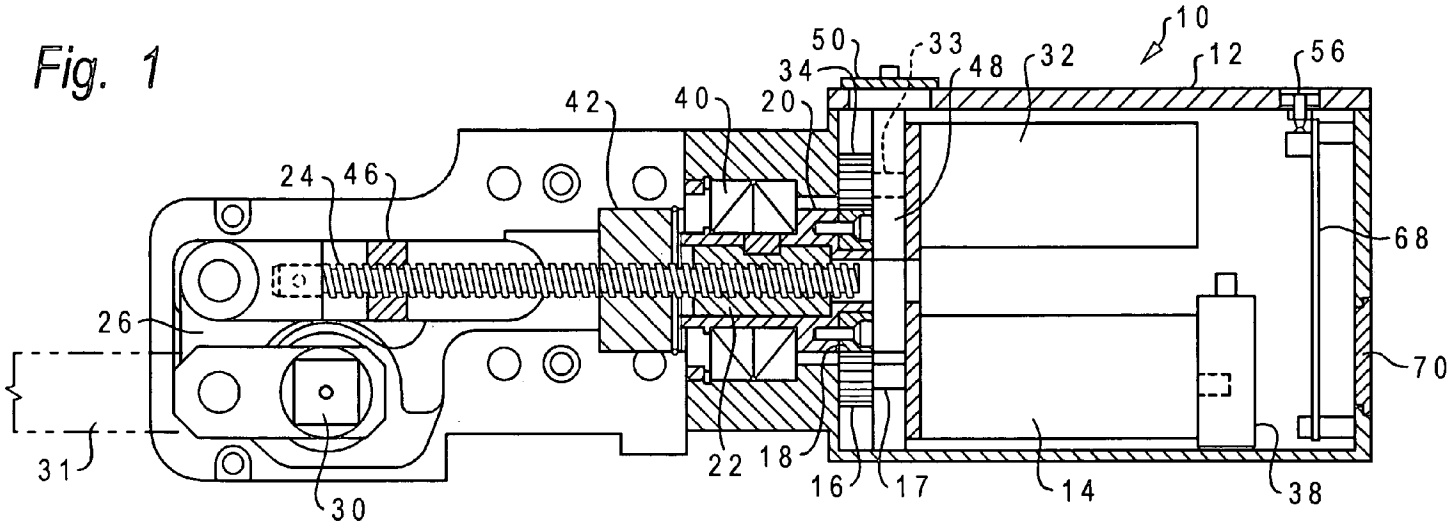
FIG. 1 is a side view of an electric clamp constructed in accordance with one embodiment of the present invention showing the clamp in its clamped position.
Figure 2:
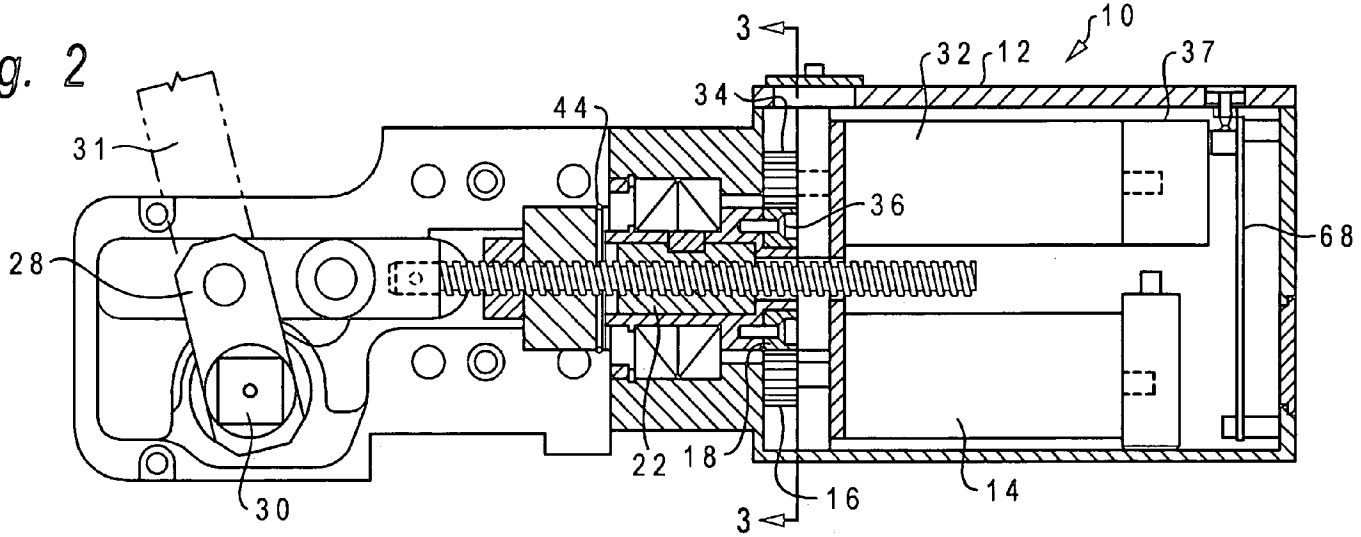
FIG. 2 is a side view of the clamp of FIG. 1, but showing the clamp in its unclamped position.

FIGS. 1 and 2 illustrate an electric clamp 10. Electric clamp 10 has a housing 12 that serves as a base on and inside of which other structural elements are mounted. Housing 12 protects the housed components. Housing 12 can be made of any durable, lightweight material, but is preferably metal or another conductive material that can be electrically grounded. It is desirable that housing 12 be easily formed into complex shapes to allow for space-efficient integration of various components. The housing can be an extrusion to minimize cost and to allow the control circuit board (described below) to be slid into a retaining slot in the walls of the housing.

Electric clamp 10 further comprises a motor 14. Motor 14 is a conventional electrically driven motor that mounts to housing 12 and serves to drive motor gear 16. The motor 14 can be virtually any type of electric motor. Different applications may dictate whether the motor is preferably an ac or dc motor, a stepper motor, an induction motor, a brushless motor, or other less common motor type. A dc motor offers the advantages of low cost and simple control requirements, but other requirements may dictate other motor types. Larger motors are generally required for larger clamps.

Figure 3:
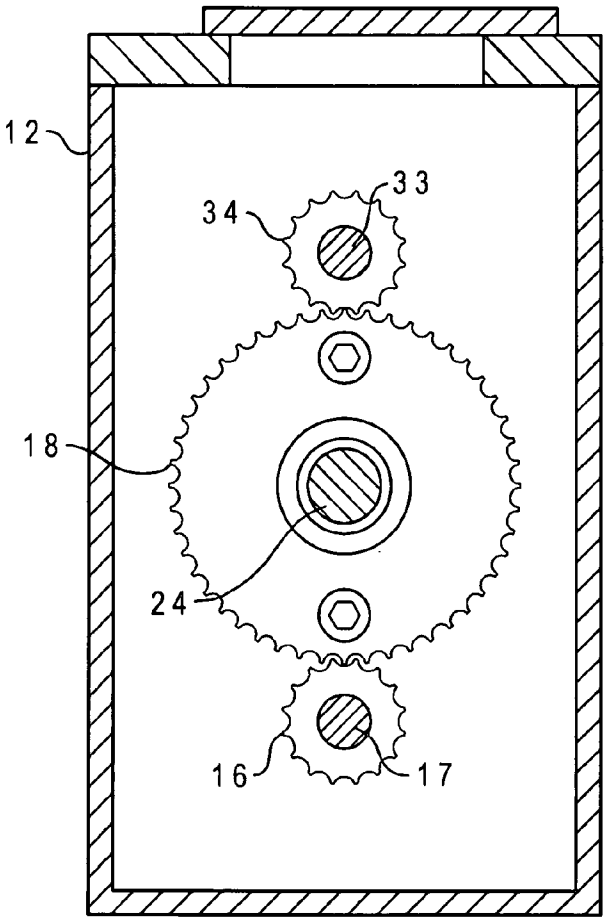
FIG. 3 is a section view along Section 3—3 of FIG. 2.

Motor gear 16 is on the output shaft 17 of motor 14 and engages ball nut gear 18 (FIG. 3). Ball nut gear 18 attaches to and drives ball nut hub 20 in response to motor gear 16. Hub 20 attaches to and drives ball nut 22. As ball nut 22 is rotated in place by hub 20, ball screw 24, a threaded shaft going through ball nut 22, advances or retreats depending on the direction of rotation of ball nut 22. The gear ratios for motor gear 16 and ball nut gear 18 can be chosen to produce a desired torque or rotational rate for ball nut 22. That determines the power or rate of advance/retreat of ball screw 24.

One end of ball screw 24 pivotally attaches to one end of link 26. The opposite end of link 26 pivotally attaches to an end of link 28. Clamp output shaft 30 is rigidly attached to the opposite end of link 28. Clamp arm 31 (shown in phantom line) is mounted to clamp output shaft 30. Clamp arms of various sizes can be attached, depending on a user's needs.

In the embodiment of FIG. 1, slave motor 32 is used to provide additional torque. Slave motor 32 is wired in parallel with motor 14 to assist motor 14. The same voltage is applied to both motors. Slave motor 32, through its output shaft 33, drives motor gear 34, which drives ball nut gear 18, each identical in operation to motor 14, output shaft 17, and motor gear 16, respectively. More complex motor amplifiers may be adapted to drive ac, stepper or brushless motors.

In the basic operation of clamp 10 of FIG. 1, power is supplied to motors 14 and 32 to drive motor gears 16 and 34. Those gears drive ball nut gear 18, which drives hub 20. Hub 20 rotates ball nut 22. Ball nut 22 drives ball screw 24, which drives links 26 and 28, rotating clamp output shaft 30 to a fully clamped (FIG. 1) or fully released (FIG. 2) position, depending on the direction of rotation of ball nut 22.

It will be appreciated that in alternative embodiments, that a lead screw can be employed in lieu of ball screw 24 in order to reduce cost. A ball screw will, however, provide greater efficiency (e.g., 90% versus 60% efficiency for a lead screw).

FIG. 2 shows an optional brake 37 attached to the motor shaft 33 of slave motor 32 that can be used to stop slave motor 32, and therefore stop the motion of clamp 10. Brake 37 may be required if large clamp arms having high rotational inertia or significant weight are used. In those situations, the inertia or moment may cause clamp 10 to move toward the clamped or unclamped position even though no power is applied. Brake 37 prevents such drift. An electronic brake can also be achieved by electronically shorting the motor leads together once the clamp achieves a desired position.

While the structural elements described above are sufficient to describe the basic configuration and operation of clamp 10, there are many other elements that enhance its functionality. Encoder 38 mounts to motor 14. The encoder 38 shown in FIG. 1 attaches to motor shaft 17 of motor 14. Encoder 38 provides motor angle information for position feedback. The motor angle information tells how far motor 14 has rotated from the clamped or unclamped position, therefore determining the position of clamp arm 31. An absolute or incremental encoder can be used, or another type of motor position sensor, such as a resolver, can be used.

Figure 19A:
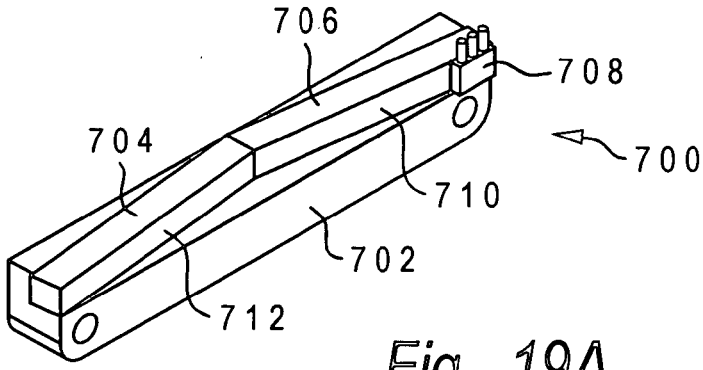
FIG. 19A is an isometric view of an exemplary absolute position sensor in accordance with the present invention.
Figure 19B:
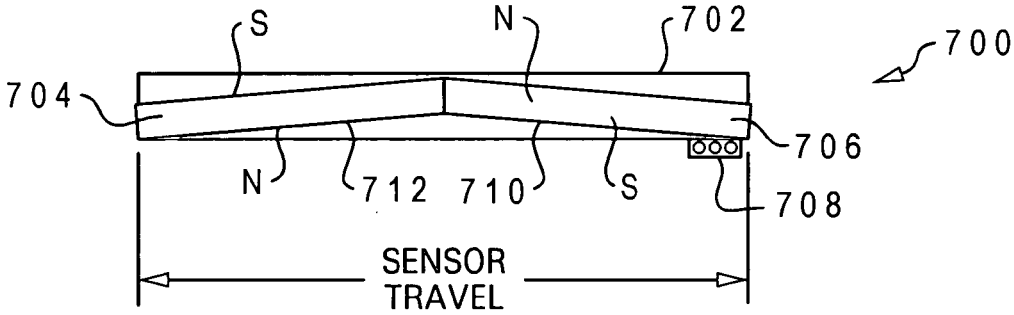
FIG. 19B is a top view of the absolute position sensor shown in FIG. 19A.
Figure 19C:
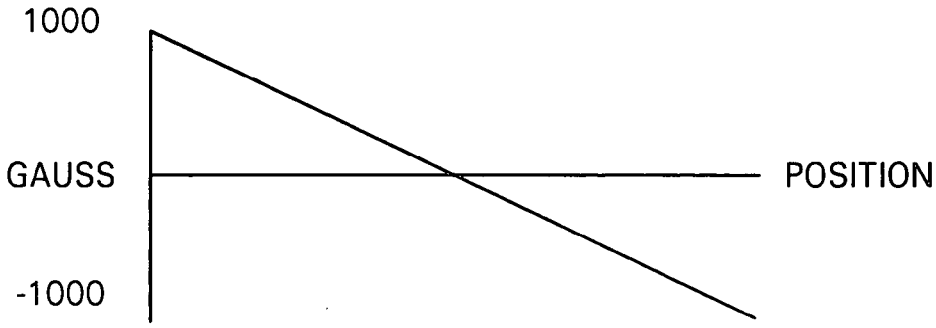
FIG. 19C is a graph plotting the relationship between linear position and magnetic field strength.

In an alternative embodiment, the absolute position of any axially movable member, such as ball screw 24, within an automated tool and thus the position of clamp arm 31 or other portion of a tool head can be determined by an absolute position sensor. For example, as shown in FIGS. 19A–19B, in one embodiment, an absolute position sensor 700 includes a non-magnetic support bracket 702 made of, for example, plastic or aluminum. Support bracket 702 supports a pair of elongate magnets 704, 706 of opposite polarity. For example, as indicated in FIG. 19B, surface 710 of magnet 706 has a "South" polarity, and corresponding surface 712 of magnet 704 has a "North" polarity. Magnets 704, 706 are separated by a small central gap (e.g., 0.1 inches) and are arranged in a "V" configuration such that the strength of the magnetic field along magnets 704, 706 varies substantially linearly with axial position of the axially movable member as shown in FIG. 19C.

Figure 19D:
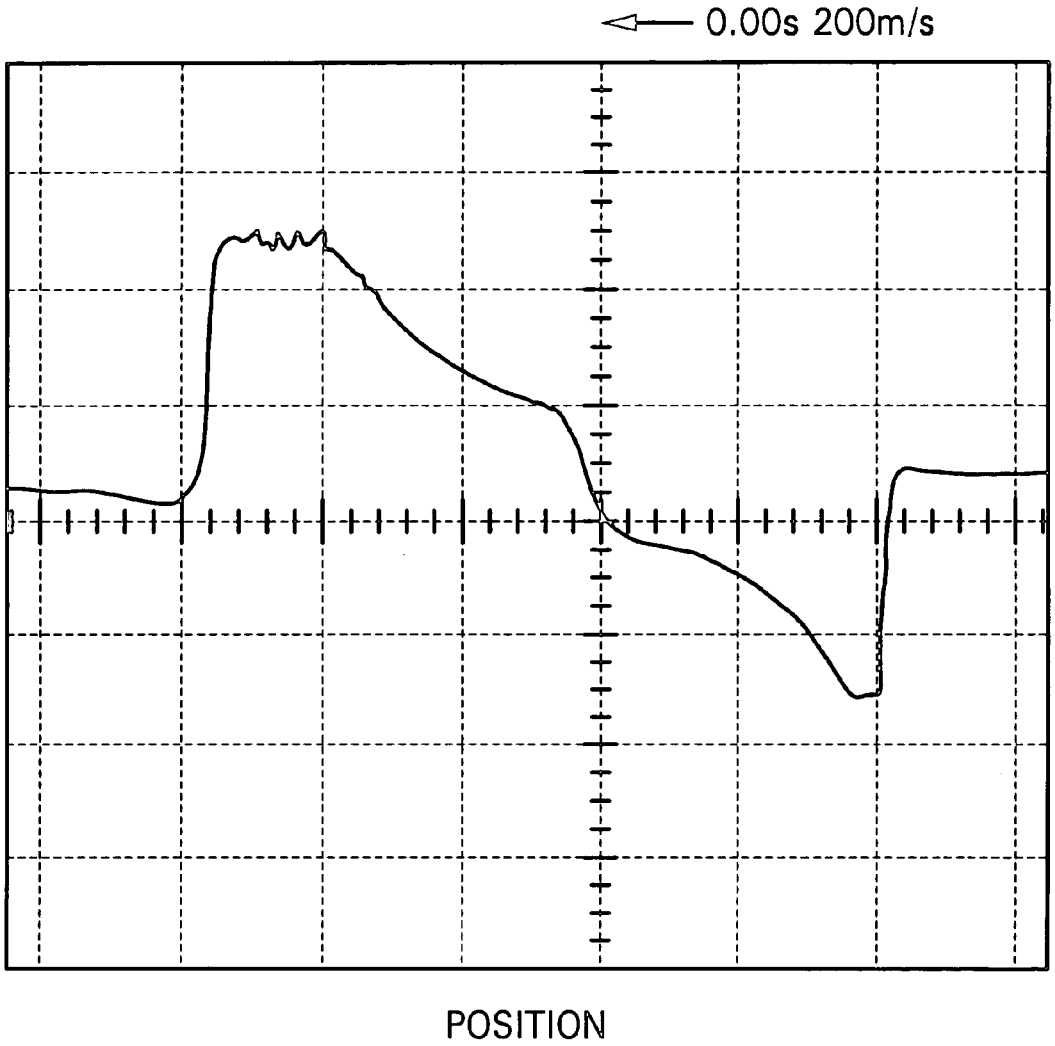
FIG. 19D is a graph plotting the output voltage signal of the Hall-effect sensor of the absolute position sensor versus linear position.

Absolute position sensor 700 further includes a Hall-effect sensor 708 that is coupled to the axially movable member such that Hall-effect sensor 708 moves along surfaces 710, 712 of magnets 704, 706 as depicted in FIG. 19B. With the illustrated "V" arrangement of magnets 704, 706 with respect to the linear path of travel of Hall-effect sensor 708, the magnetic field strength sensed by Hall-effect sensor 708 and thus the output voltage signal of Hall-effect sensor 708 varies substantially linearly with position, as shown in the experimental plot of voltage versus position given in FIG. 19D.

Referring again to FIGS. 1 and 2, ball nut 22 may be further supported by thrust bearing 40. Thrust bearing 40 mounts between housing 12 and ball nut 22 and carries the thrust load generated during the clamping process. Similarly, ball screw 24 is supported by support bearing 42. Bearing 42 mounts between housing 12 and ball screw 24 and prevents lateral loads from being transferred to ball screw 24 during extreme loading conditions. Bearing 42, in conjunction with retainer ring 44, also acts as a barrier to prevent grease from moving from links 26, 28 into the vicinity of ball nut 22.

Stop collar 46 is adjustably fixed to ball screw 24 and physically inhibits further retraction of ball screw 24 once stop collar 46 is pulled into contact with bearing 42. This feature is useful to prevent clamp 10 from opening too far. The need for restriction commonly arises when objects in the vicinity of clamp 10 interfere with the full range of motion of clamp 10, particularly when longer clamp arms are used.

Figure 4:
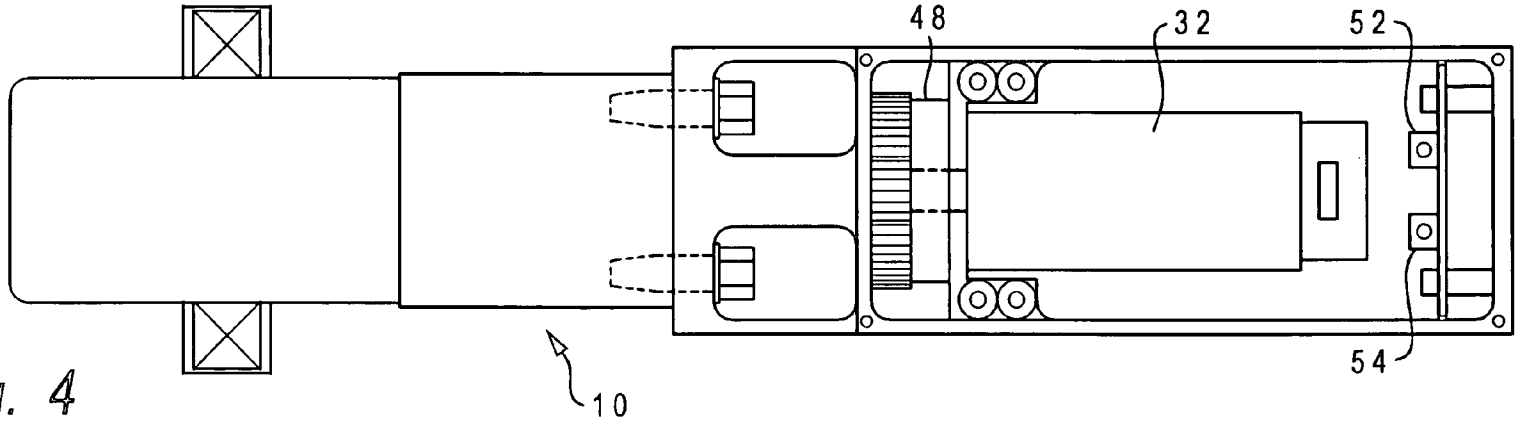
FIG. 4 is a top view of the clamp of FIG. 1 with cover removed.
Figure 5:
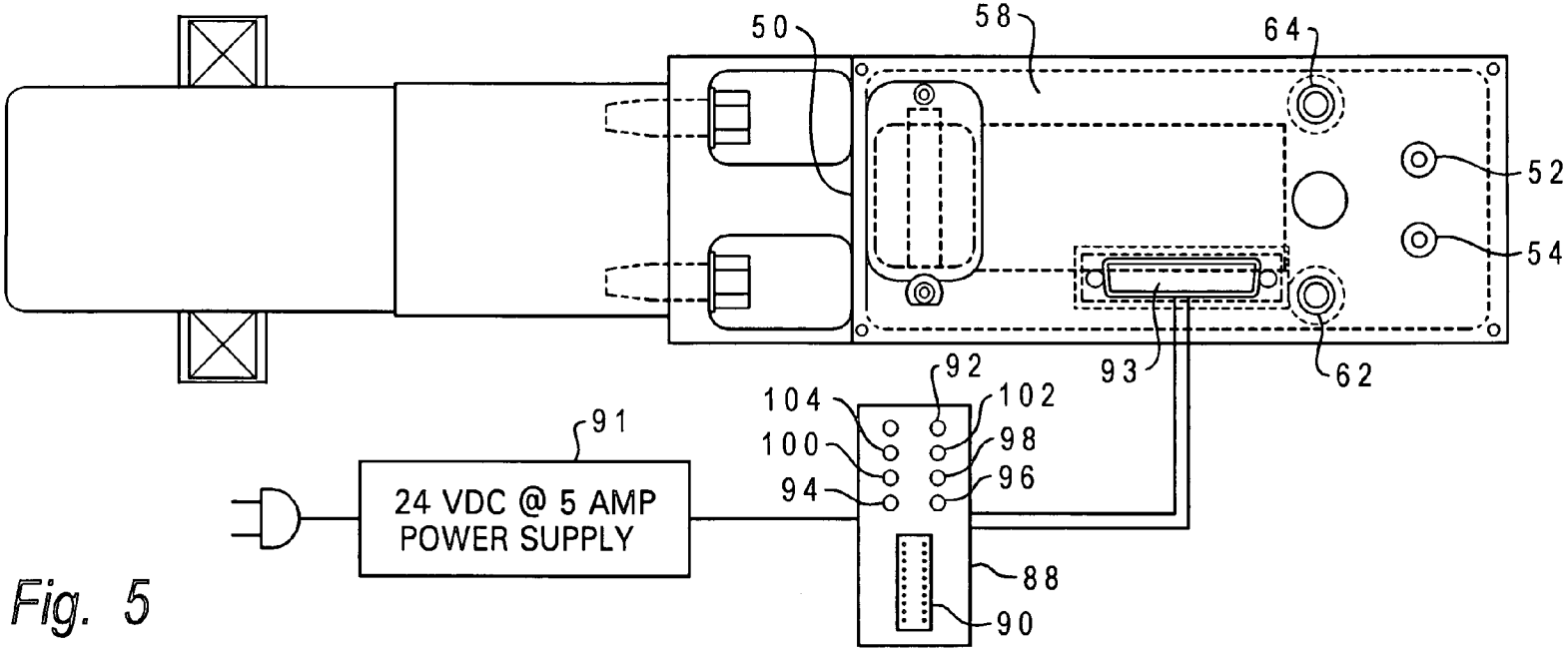
FIG. 5 is a top view of the clamp of FIG. 1 with cover on and remote pendant attached.

FIG. 4 shows thumb wheel 48 attached to the motor shaft of slave motor 32. Thumb wheel 48 allows clamp 10 to be moved without electrical power. This is useful when no power is available, such as during initial setup, or when the drive control electronics (described below) are unavailable. This can occur when clamp 10 becomes extremely stuck or the electronics themselves fail. Wheel 48 is normally concealed and protected by access cover 50, as shown in FIG. 5. A separate thumb wheel is not required because the user can turn the motor manually by other means, for example, by pushing a drive belt accessible via access cover 50 as described below with respect to FIGS. 8–9.

FIG. 5 also shows clamp buttons 52 and 54. Buttons 52, 54 allow a user to drive clamp 10 to a clamped or unclamped position, respectively. The motion produced is relatively slow in both directions and clamp 10 moves only while a button is depressed. Buttons 52, 54 are located in recesses 56 (FIG. 1) in cover plate 58. Recesses 56 are covered to prevent infiltration of contaminates and to prevent inadvertent engagement of buttons 52, 54. A pointed tool, such as a screwdriver, is needed to actuate buttons 52, 54.

Also located on cover plate 58 are status lights 62, 64. Clamped status light 62, when lit, indicates clamp 10 is very close to the programmed clamped position. (The programmable aspects are discussed below.) Similarly, unclamped status light 64 lights up when clamp 10 is very close to the programmed unclamped position. In addition, there are indicator lights 66 (FIG. 6) on control circuit board 68 (FIG. 2) within housing 12. Indicator lights 66 are viewed through window 70 (FIG. 1) and provide an operator information about the operational state of clamp 10.

Electrical power is primarily supplied to clamp 10 through control cable 72 (FIG. 6), which fastens to cover plate 58 and electrically connects a wire bundle to electronics within housing 12. Power could be dc, ac, 24 volts, or 48 volts—a preferred embodiment uses 24 volts dc. Higher voltages, such as 110 or 220 ac voltages, could be used, but are generally considered unacceptable because of safety concerns. Electrical power is typically provided by an external power supply with enough current capacity to service several clamps.

As will be appreciated by those skilled in the art, the external power supply voltage may be the same or different from the motor voltage. For example, electric clamp may include an internal motor power supply containing a voltage doubler circuit that doubles 24 VDC power to obtain 48 VDC.

In one preferred embodiment, separate internal logic and motor power supplies are employed to isolate the logic power supply that powers the onboard controller from the motor power supply that powers the electric motor(s) (and which tends to be subject to more electrical noise). In addition to providing electrical isolation, implementing separate power supplies permits power to be supplied to the onboard controller while motor power is interrupted (e.g., in an emergency situation).

Other electrical signals, such as a command signal from the user or clamp status information, are also transmitted through control cable 72. The electronics within housing 12 include control circuit board 68 (FIG. 1). Control board 68 has the circuitry necessary to control clamp 10.

Figure 7:
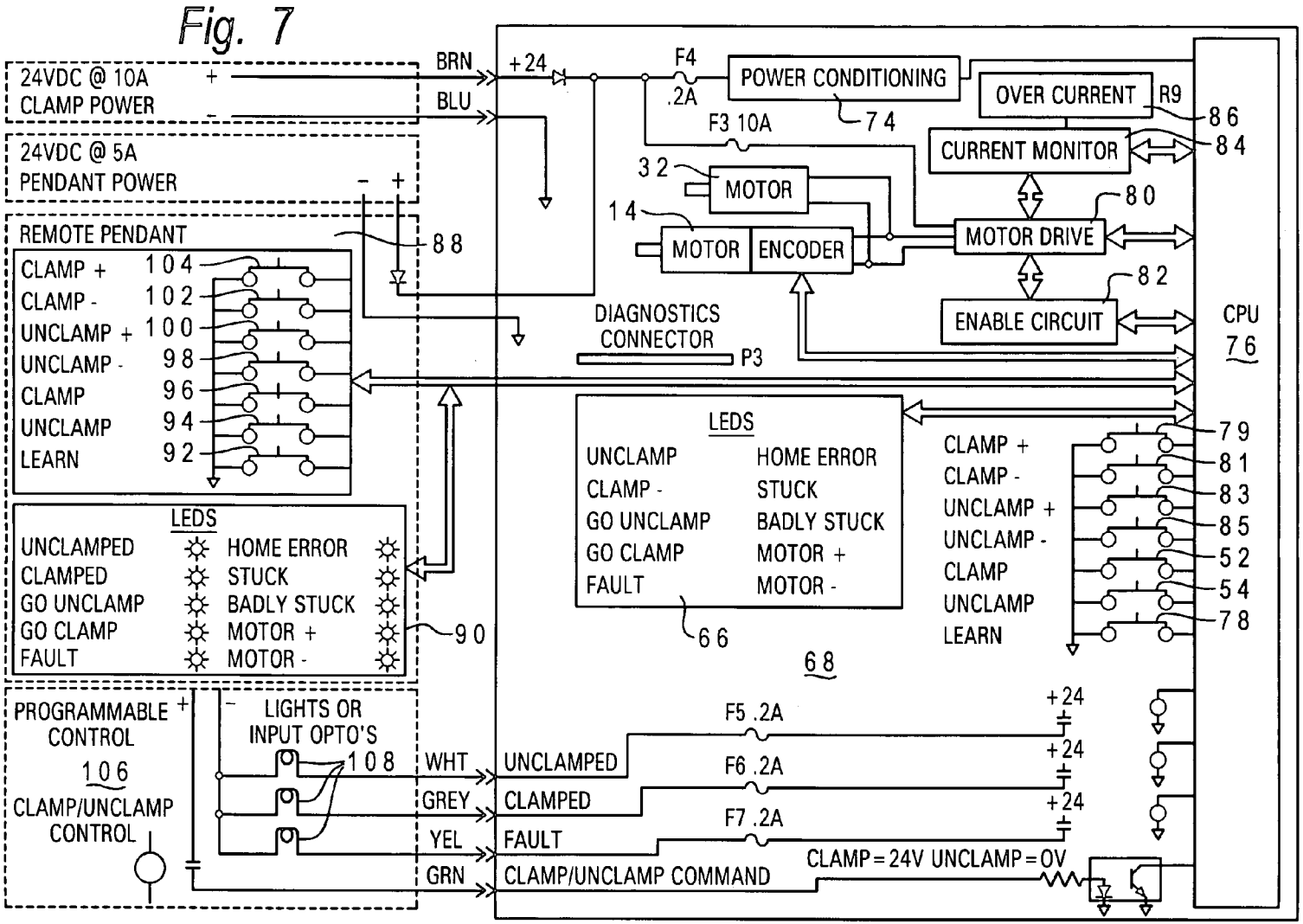
FIG. 7 is a schematic diagram of the electronics used in the clamp of FIG. 1.

FIG. 7 shows conceptually the electronic components comprising control board 68. Power conditioner 74 is used to provide clean 5 and 15 volts dc signal to control board 68. A CPU 76 mounted to control board 68 controls all aspects of the operation of clamp 10. CPU 76 comprises timers, counters, input and output portals, memory modules, and programmable instructions to regulate motion algorithms, error recovery, status messaging, test display, limit adjustment, and pushbutton control. Indicator lights 66 are connected to CPU 76.

Clamp 10 has pushbuttons 79, 81, 83, 85 on the exterior of housing 12 to permit a user to adjust the position to which CPU 76 will command the motor to move upon receiving a clamp or unclamp command. There is also a pushbutton 78 allowing CPU 76 to learn and memorize the clamped position based on when the motor stalls. This is usually a quicker way to set the programmed clamp position than by using pushbuttons 79, 81, 83, 85. All of those pushbuttons 78, 79, 81, 83, 85, as well as clamp/unclamp buttons 52, 54, are illustrated in FIG. 7.

CPU 76 controls motor drive circuit 80 and enabling circuit 82. Those circuits 80, 82 supply the drive current sent to slave motor 32 and motor 14. Because motor drive circuit 80 is easily damaged by logically inconsistent electrical input, enabling circuit 82 is used to independently assure logically consistent input. If excess current is detected by current monitor 84, such as may occur if clamp 10 is stalled or stuck, the output from motor drive circuit 80 is inhibited. A user may set an over-current threshold using over-current circuit 86.

All user interfaces described above are also found on remote pendant 88 (FIG. 5). Thus, remote pendant 88 allows a user to operate clamp 10 some short distance from clamp 10. This can be useful if clamp 10 is placed deeply within an automation tool, making the interfaces on housing 12 inaccessible. Lights 90 equivalent to indicator lights 66 are found on remote pendant 88, so clamp status information can be observed. Remote pendant power supply 91 (FIG. 5) provides electrical power to clamp 10 through remote pendant 88 via connector 93 on cover plate 58. This is useful if conventional power is unavailable, as is often the case in the early stages of building an automation system. Pushbuttons 92, 94, 96, 98, 100, 102, and 104, provide the same functionality as pushbuttons 78, 54, 52, 85, 83, 81, and 79, respectively, using remote pendant 88. As described below with respect to FIG. 14, the pushbuttons and status lights may advantageously be combined with a single keypad interface.

Clamps used in the automation industry are commonly used in conjunction with hundreds of other clamps, each clamp performing a specific function in a carefully choreographed manner. Often the multitude of clamps is controlled by a central controller issuing commands to the various clamps at the proper time. Clamp 10 accepts such external control commands through interface 106 (FIG. 7). Clamp 10 is typically isolated from the external controller using optical isolators 108; however, simple lights or light emitting diodes (LEDs) may also be used. The lights or LEDs can convey essential status information such as clamped, unclamped, or a fault condition. This information can be passed to the central controller as well.

Referring now to FIG. 8, an alternate embodiment of the present invention is depicted as clamp 210. Like the preceding embodiment, the components of clamp 210 are located entirely within its housing 212, other than the clamp arm 231 and the remote pendant (not shown). The primary difference between clamp 210 and clamp 10 of FIGS. 1 and 2 is the belt drive assembly 201 (FIG. 9) utilized by clamp 210. Thus, clamp 210 is very similar to clamp 10, but in this embodiment of the present invention, the direct gear-to-gear drive assembly of clamp 10 illustrated in FIGS. 1–3 is replaced by the belt drive assembly 201. The belt drive assembly 201 uses at least one drive sprocket (two are shown: 216, 234), a drive belt 207, and a center sprocket 218. The sprockets 216, 234, and 218 have external teeth that engage internal grooves on the drive belt 207. The drive sprockets 216, 234 engage and drive the belt 207, which, in turn, drives the center sprocket 218. Sprockets 216, 234 are mounted to drive shafts 217, 233, which extend from motors 214, 232, respectively. These components are similar or identical to the drive shafts 17, 33 and motors 14, 32, described above for the previous embodiment.

To maintain adequate separation, sprockets 216, 234 are sufficiently spaced apart in a radial direction (relative to their axes of rotation) so as to not make direct contact with the center sprocket 218 that is located between sprockets 216, 234. Center sprocket 218 is mounted to and drives a ball nut hub 220 having internal threads. As ball nut hub 220 is rotated by center sprocket 218, a ball screw 224 advances or retreats depending on the direction of rotation of ball nut 222. Ball screw 224 is a threaded shaft going through ball nut hub 220, and is otherwise identical in function to ball screw 24 as described above. The tooth ratios for sprockets 216, 234, 218, and belt 207 are selected to produce a desired torque or rotational rate for ball nut hub 220, which determines the power or rate of advance/retreat of ball screw 224. Other than the components employed and operated by belt drive assembly 201, clamp 210 utilizes the same elements and operates in an identical manner as the previously described embodiment including, for example, a sensor or encoder 238 on motor 214. The ball screw 224 is coupled to a linkage 226 to manipulate an output shaft 230 and a clamp arm 231.

Figure 10:
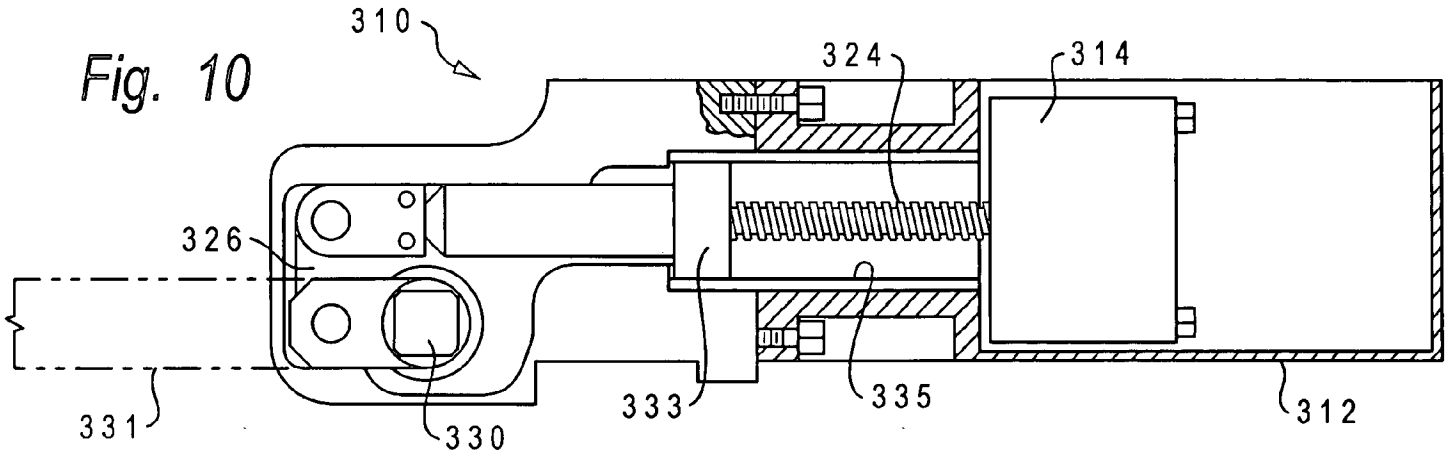
FIG. 10 is a side view of an electric clamp constructed in accordance with a third embodiment of the present invention showing the clamp in its clamped position.
Figure 11:
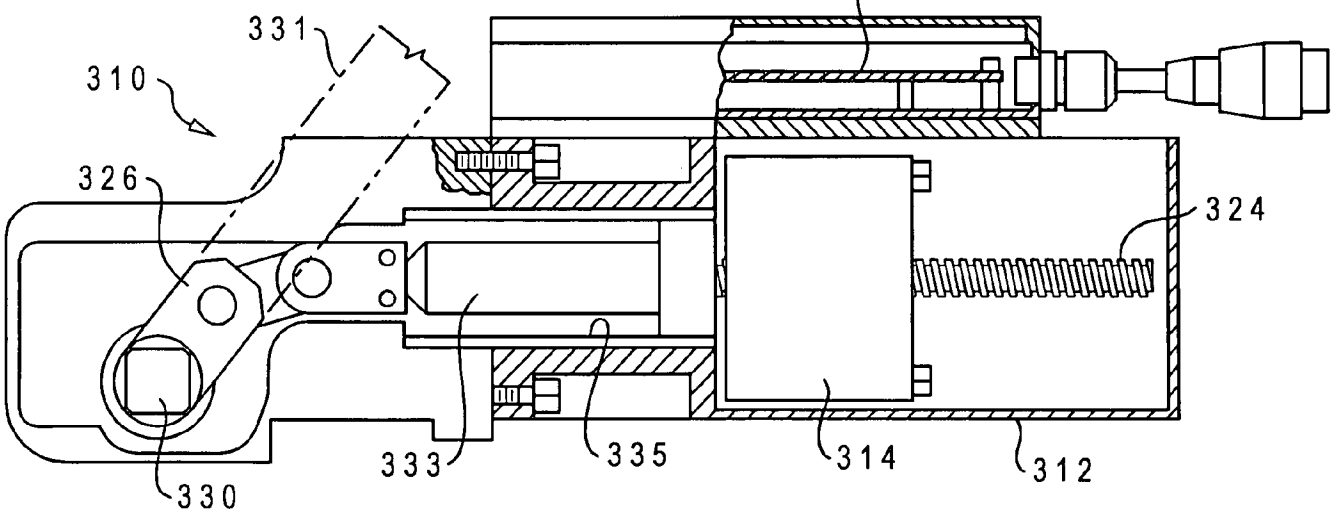
FIG. 11 is a side view of the clamp of FIG. 10, but showing the clamp in its unclamped position.

Referring now to FIGS. 10 and 11, a third embodiment of the present invention is depicted as an electric clamp 310. Electric clamp 310 has a housing 312 and a number of other components including a lead screw 324, which are all entirely enclosed within housing 312. Clamp 310 is similar to the preceding embodiments in many respects, but differs primarily in the manner in which it manipulates the output shaft 330 and clamp arm 331. In particular, clamp 310 uses a single electric motor 314, which is preferably a linear actuator, to advance and retreat a lead screw 324 extending axially through the motor 314. Consequently, no separate ball nut hub or ball nut is required.

The lead screw 324 is further coupled to the output shaft 330 through components such as a linkage 326 and a piston 333. The piston 333 is mounted in a chamber 335 that is located within the housing 312. In this disclosure, the terms piston and chamber are not necessarily used in the conventional sense to include a sealing relationship. Rather, these terms are used to denote the relative motion of the components, i.e., substantial restriction of radial motion of the piston by the chamber, while allowing the piston to move axially within the chamber. In the version shown, motor 314, lead screw 324, and piston 333 are coaxial. The piston 333 is coupled to the lead screw 324 and the output shaft 330, such that axial movement of the lead screw 324 by the electric motor 314 moves the piston 333 axially within the chamber 335, and moves the output shaft 330 and the clamp arm 331 through a range of motion. The other components described above and used in conjunction with the previous embodiments are likewise available for use with and employed by clamp 310. In this version of the invention, the control circuit 368 of electric clamp 310 is located in an upper portion of the housing 312.

Figure 12:
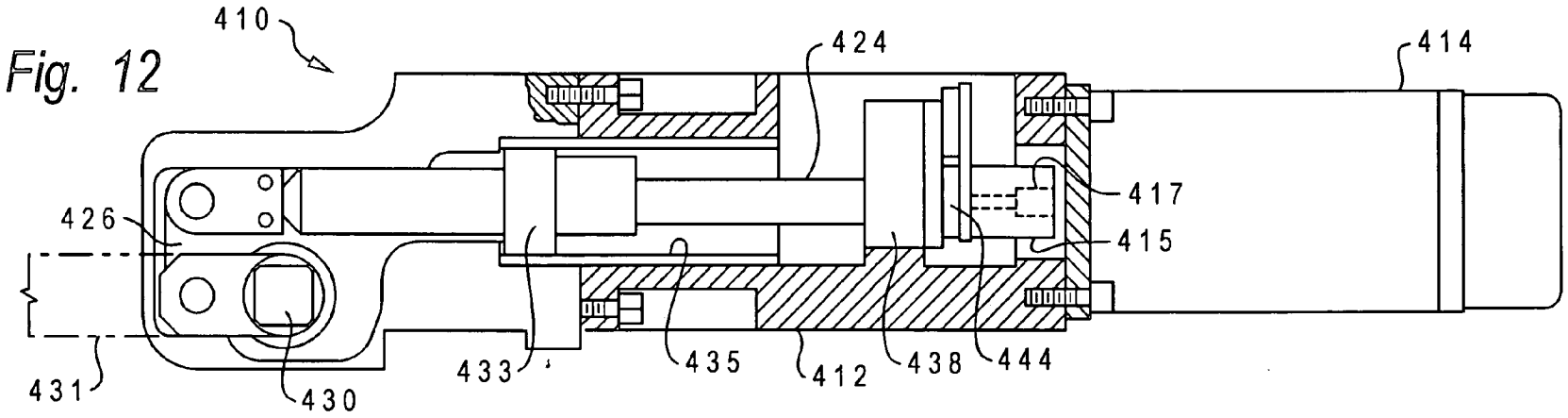
FIG. 12 is a side view of an electric clamp constructed in accordance with a fourth embodiment of the present invention showing the clamp in its clamped position.
Figure 13:
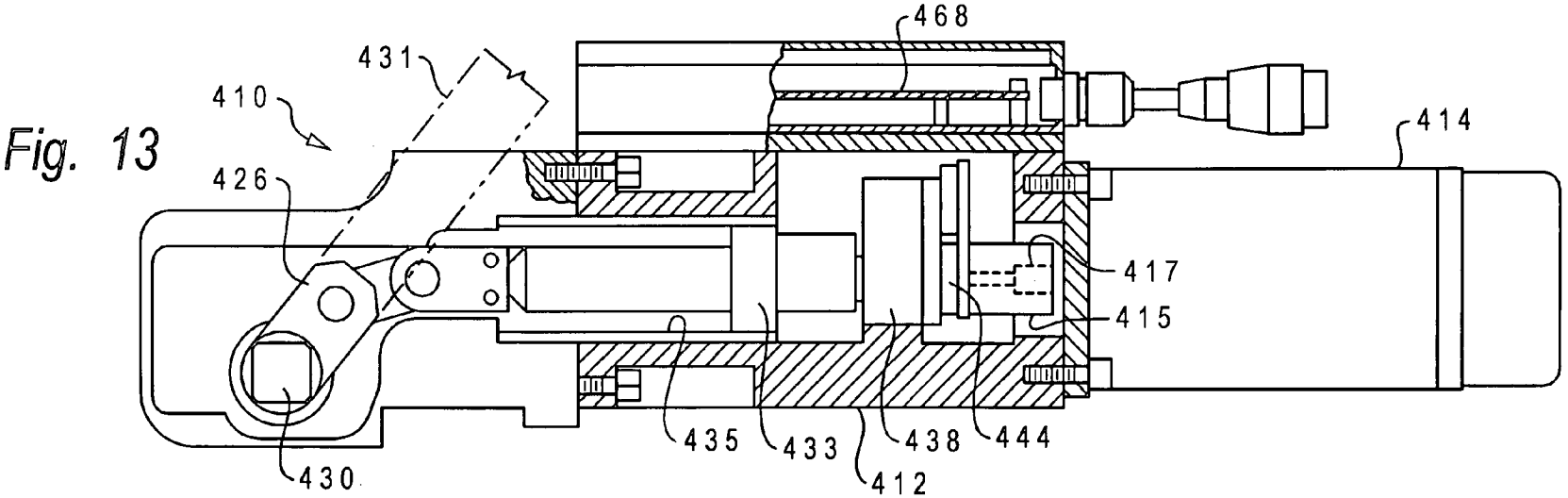
FIG. 13 is a side view of the clamp of FIG. 12, but showing the clamp in its unclamped position.

Referring now to FIGS. 12 and 13, a fourth embodiment of the present invention is depicted as an electric clamp 410. Clamp 410 utilizes many of the components and features of the preceding embodiments, including a housing 412 and an electric motor 414 with a drive shaft 417 that is rotatable about an axis. In the depicted embodiment, motor 414 is mounted to an exterior of the housing 412, and drive shaft 417 protrudes into the housing 412. A helical coupling 415 is mounted to drive shaft 417 and is coupled to a ball nut hub (not shown). A ball screw 424 extends axially through the ball nut hub such that the ball screw 424 is axially advanced and retreated by rotation of the ball nut hub. The ball screw 424 is entirely enclosed within the housing 412. The housing 412 also contains a chamber 435 that is coaxial with the drive shaft 417. A piston 433 is located in the chamber 435, and the piston 433 is coupled to the ball screw 424 such that movement of the ball screw 424 by the electric motor 414 moves the piston 433 axially within the chamber 435.

An output shaft 430 is also mounted to the housing 412. The output shaft 430 has a linkage 426 coupled to the piston 433 for movement therewith, and a mounting portion for a movable element (clamp arm 431) to permit the movable element to at least partially extend from the housing 412, and move the clamp arm 431 between clamped and unclamped positions. As described above for the previous embodiments, clamp 410 also has a control circuit 468 located within an upper portion of the housing 412 for controlling the motor 414, and a sensor 438, such as an encoder, that provides a signal to the control circuit indicative of a current position of the clamp arm 431. The sensor 438 is coupled to the drive shaft 417 via a set of gears 444, and the signal provided to the control circuit is indicative of a rotational position of the drive shaft 417. The clamp 410 further comprises a remote pendant (not shown), which is identical to the one described above.

Figure 14:
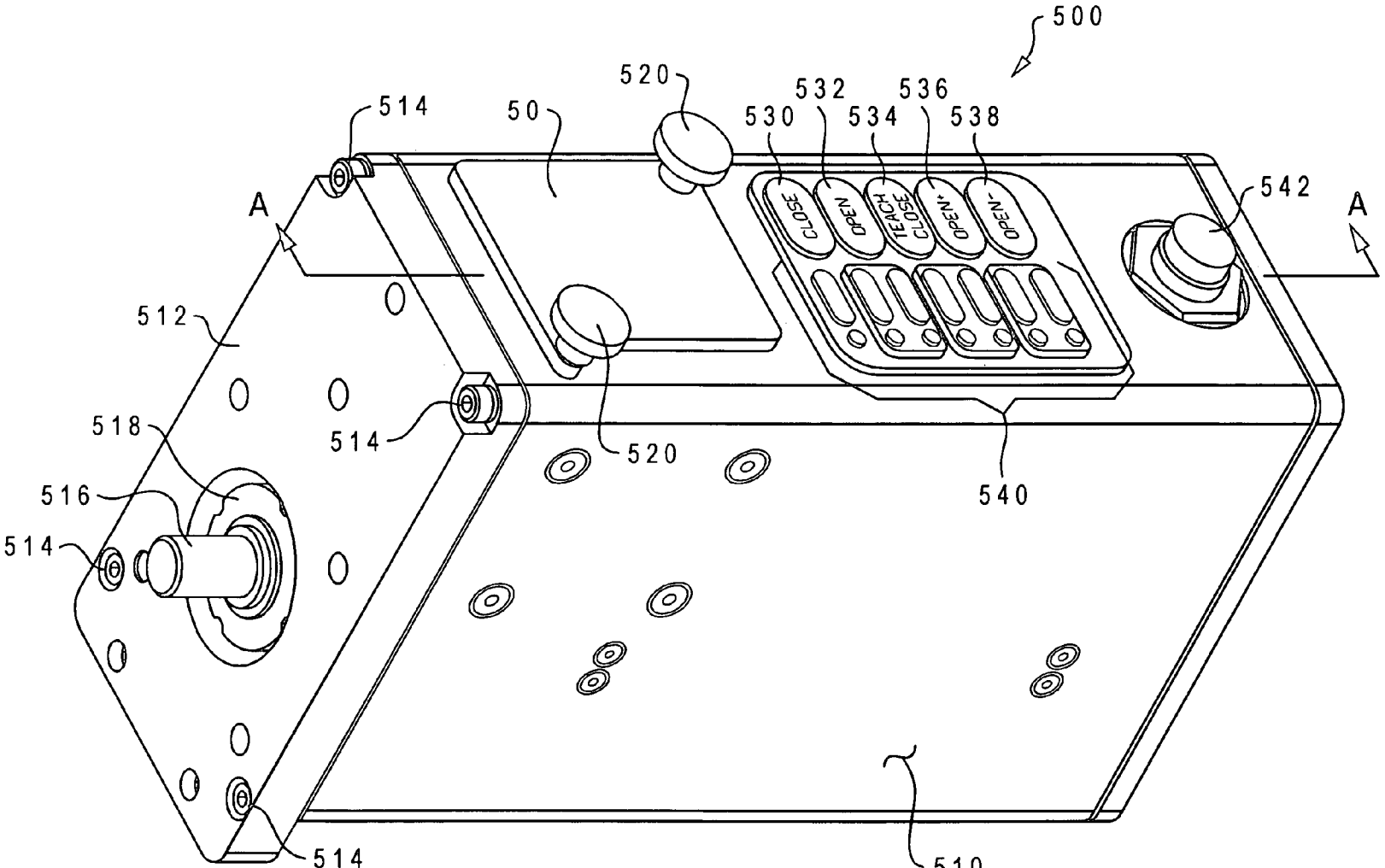
FIG. 14 is an isometric view of an exemplary embodiment of a motor pack for an automated tool.

With reference now to FIG. 14, there is illustrated a motor pack 500 in accordance with the present invention, which may be utilized to drive an automated tool, such as one of the electric clamps described above. Thus, motor pack 500 may be employed to drive electric clamp 10 (FIGS. 1 and 2), electric clamp 210 (FIG. 8), electric clamp 310 (FIGS. 10 and 11), electric clamp 410 (FIGS. 12 and 13), or another electrically driven tool.

As shown, motor pack 500 includes a housing 510 that serves as a base on and inside of which other structural elements are mounted. Housing 510 protects the housed components. Housing 510 can be made of any durable, lightweight material, but is preferably metal or another conductive material that can be electrically grounded. It is desirable that housing 510 be easily formed into complex shapes to allow for space-efficient integration of various components.

Housing 510 includes a front plate 512 that mates with a tool head, such as a clamp head, gripper head, pin clamp head, etc. Housing 512 further includes attachment means by which housing 512 may be removably secured in operative relation to a tool head. Although in the illustrated embodiment the attachment means are implemented as threaded screw holes 514, in alternative embodiments, the attachment means may include screws passing through holes in front plate 512 that engage with threaded holes in the tool head, clamps, locking members, and/or any other means for removably attaching housing 512 to the tool head.

As in the previously described electric clamp embodiments shown in FIGS. 10 and 11, housing 510 partially houses a lead screw 516 that is advanced from and retracted into housing 510 by the operation of one or more electric motors. Lead screw 516 preferably extends from housing 510 through an opening in front plate 512 to permit coupling of lead screw 516 to an assembly within the tool head that operates the tool. For example, lead screw 516 may be coupled to an axially displaceable member 224, 333, 433 to drive an electric clamp or other tool, as shown in FIGS. 8, 10 and 12, respectively. The coupling between the lead screw 516 to the assembly within the tool head can be effected by a clevis pin, by uniting the threads of lead screw with corresponding internal threads in the assembly or by other well known means. In the depicted embodiment, the retraction of lead screw 516 into housing 510 is restricted by a lock nut 518.

It will be recognized by those skilled in the art that in alternative embodiments, motor pack 500 may be constructed with a front plate 512 in which an aperture is formed and through which an axially displaceable member of a tool head extends into the interior of hosing 510 for coupling to lead screw 516. Such an arrangement is less preferred, however, because the construction shown in FIG. 14, with lead screw 516 extending from housing 510 advantageously permits use of motor pack 500 with existing pneumatically and electrically driven tool heads.

Housing 510 has a second aperture on its top surface to permit access to the electric motor housed within housing 510. The second aperture is concealed by a removable access cover 50, as described above with reference to FIG. 5. Removable access cover 50 is retained in place by thumbscrews 520.

Like the arrangement described above with respect to FIG. 7, motor pack 500 has a number of pushbuttons on the exterior of housing 510 to permit a user to adjust the position to which the on-board tool controller will command the motor to move the tool. For example, in embodiments in which motor pack 500 can be coupled to a clamp head, pin clamp head or pin clamp head, the pushbuttons preferably include a Close pushbutton 530 that, when depressed, causes the tool controller to run the electric motor to drive lead screw 516 toward a fully closed position, and an Open pushbutton 532 that, when depressed, causes the tool controller to run the electric motor to drive lead screw 516 toward a fully open position. Motor pack 500 also has a Teach pushbutton 534 that, when depressed, causes the tool controller to memorize as the closed position the position at which the motor stalls (e.g., because the tool has closed on a work piece). Finally, motor pack 500 has Open + and Open − pushbuttons 536 and 538, which permit the user to incrementally advance the tool toward open and closed positions, respectively. The status of the tool (e.g., power, opened, closed, fault, etc.) is indicated by a number of indicator lights 540, similar to indicator lights 66 and 90 described above.

In one embodiment, individual indicator lights 66, 90, 540 that are each indicative of a respective tool status can be replaced by a single digit alphanumeric LED display disposed on housing 12, 510 and/or on a remote pendant 88. When the automated tool is not in operation, the LED display is not illuminated. When the automated tool is operated, CPU 76 (FIG. 7) then causes one or more status messages (e.g., clamp opening angle, fault status, etc) to be displayed on the LED display as conditions are encountered utilizing alphanumeric codes. An exemplary set of status messages for an electric clamp (e.g., electric clamp 10) is given below in Table I.

TABLE I

| Alphanumeric code | Meaning |
|---|---|
| 0 | 15 degree opening angle being taught using OPEN + or OPEN − |
| 1 | 30 degree opening angle being taught using OPEN + or OPEN − |
| 2 | 45 degree opening angle being taught using OPEN + or OPEN − |
| 3 | 60 degree opening angle being taught using OPEN + or OPEN − |
| 4 | 75 degree opening angle being taught using OPEN + or OPEN − |
| 5 | 90 degree opening angle being taught using OPEN + or OPEN − |
| 6 | 105 degree opening angle being taught using OPEN + or OPEN − |
| 7 | 120 degree opening angle being taught using OPEN + or OPEN − |
| A | Auto cycle test clamp. User activated with Open +, Open − pushbuttons pressed simultaneously on boot up. |

TABLE I-continued

| Alphanumeric code | Meaning |
|---|---|
| C | Hopelessly stalled. Check for free movement with thumb wheel then cycle power. Probably due to an obstruction, mechanical, or electrical failure. |
| E | Move time out. Motor stalled. Make sure that your power supply voltage is not dipping below minimum supply voltage (e.g., 22 VDC) |
| F | New clamp or computer memory error. Open and Close positions were set to defaults. |
| H | Open and close signals are on at the same time. Turn on only one signal at a time. |
| J | No temperature sensor detected. This must be repaired before the clamp will function. Try cycling power. |
| L | Find closed error after you pressed TEACH CLOSE pushbutton. Try again. |
| P | Keypad failure or you are pressing keypad buttons when turning on power. |
| U | Amplifier over temperature threshold (e.g., 135 F.). Amplifier must cool down before continuing. Lower cycle rate. Clamp will suddenly return to operation when temperature cools down and U message will turn off. |
| b | Cannot teach open/closed position while receiving user input command. Turn off command from your PLC before proceeding. |
| c | User status outputs more than 0.3 amps. Reduce loads on your inputs. Driver IC is damaged if fault will not clear. Replace control board if fault will not clear. |
| u | Find closed clamped position was successful. |

Figure 6:
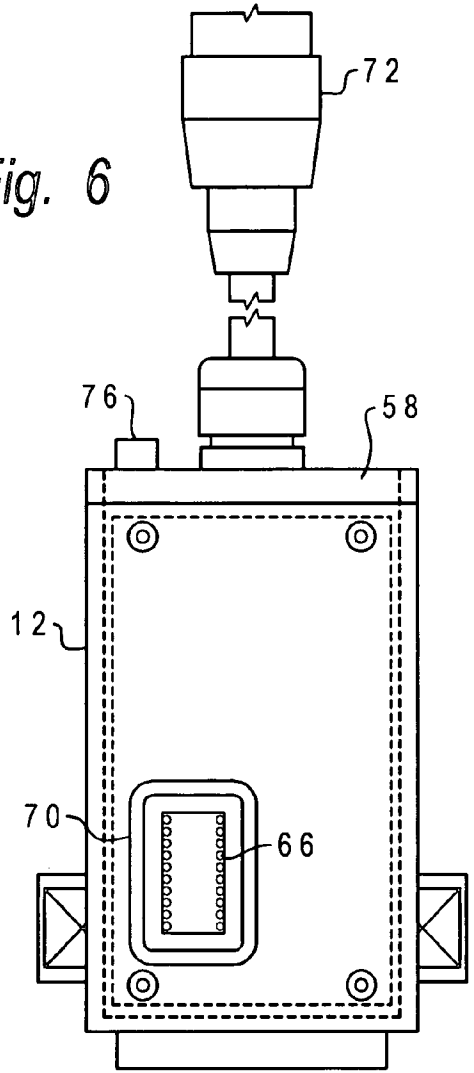
FIG. 6 is an end view of the clamp of FIG. 1.

Motor pack 500 further includes a an electrical connector 542 for coupling a power and control cable 72 to motor pack 500, as shown in FIG. 6. As described above, the power could be dc or ac, and may employ any desired voltage. Other electrical signals, such as command signals from a remote host or clamp status information transmitted by motor pack 500, may also be transmitted through control cable 72.

Figure 15:
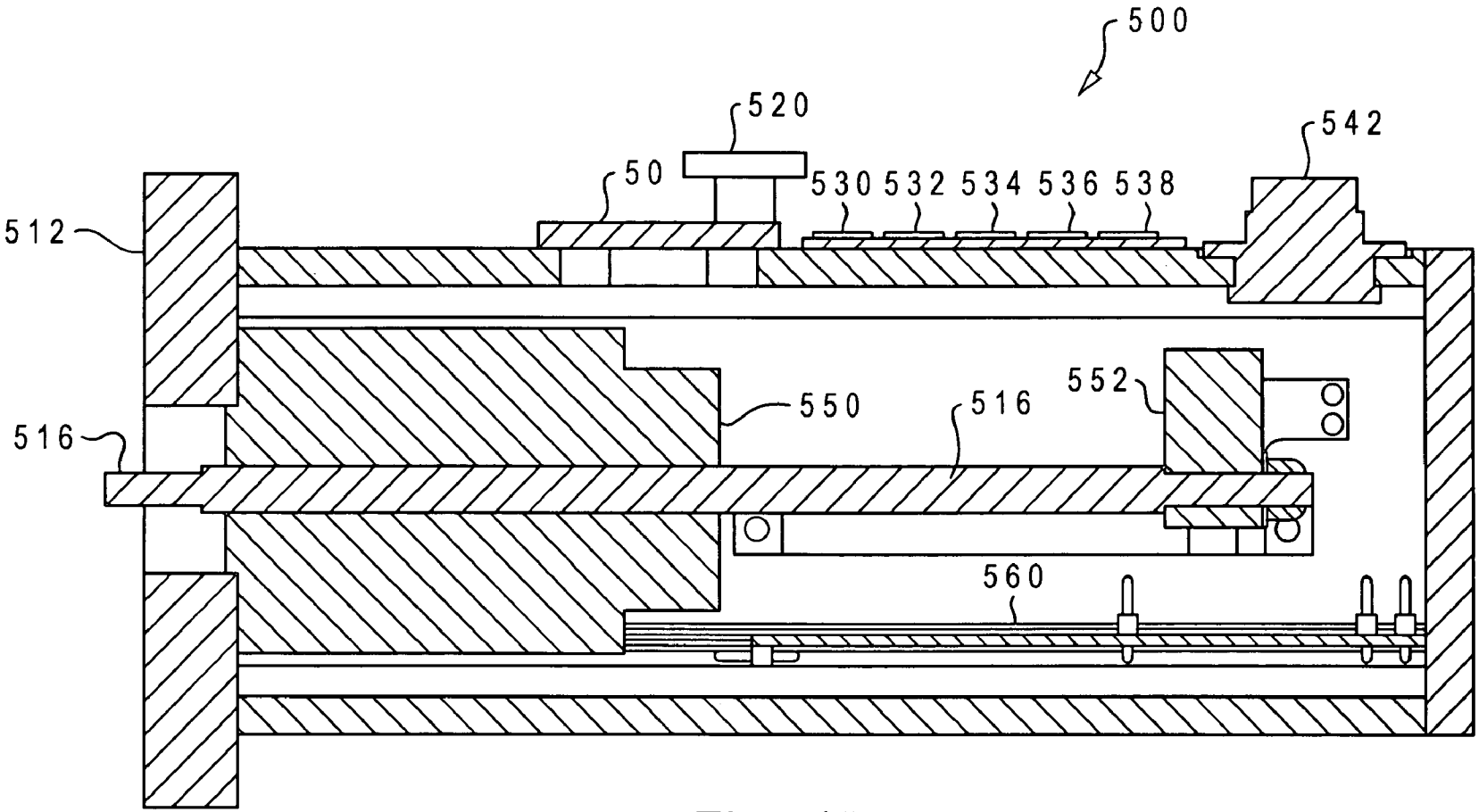
FIG. 15 is a section view of a first exemplary embodiment of a motor pack for an automated tool.

With reference to FIG. 15, there is illustrated a section view of first exemplary embodiment of motor pack 500 taken along line A—A of FIG. 14. In the depicted embodiment, which is similar to that illustrated in FIG. 11, housing 510 of motor pack 500 houses a motor 550, which is preferably a linear actuator, that advances and retreats lead screw 516. Motor 550 is electrically coupled to a control circuit board 560 including all circuitry required to control the operation of motor 550, and through linkage of the tool head with lead screw 516, the tool. In one embodiment, control circuit board 560 may be implemented as described above with respect to FIG. 7. It will also be appreciated that the tool control circuitry within control circuit board 560 may be implemented entirely in hardware or with a combination of hardware and software/firmware. In addition to the connections to motor 550, control circuit board 560 is electrically coupled to a position sensor 552 that provides feedback regarding the linear position of lead screw 516, as well as electrical connector 542, pushbuttons 530–538 and indicator lights 540.

Figure 16:
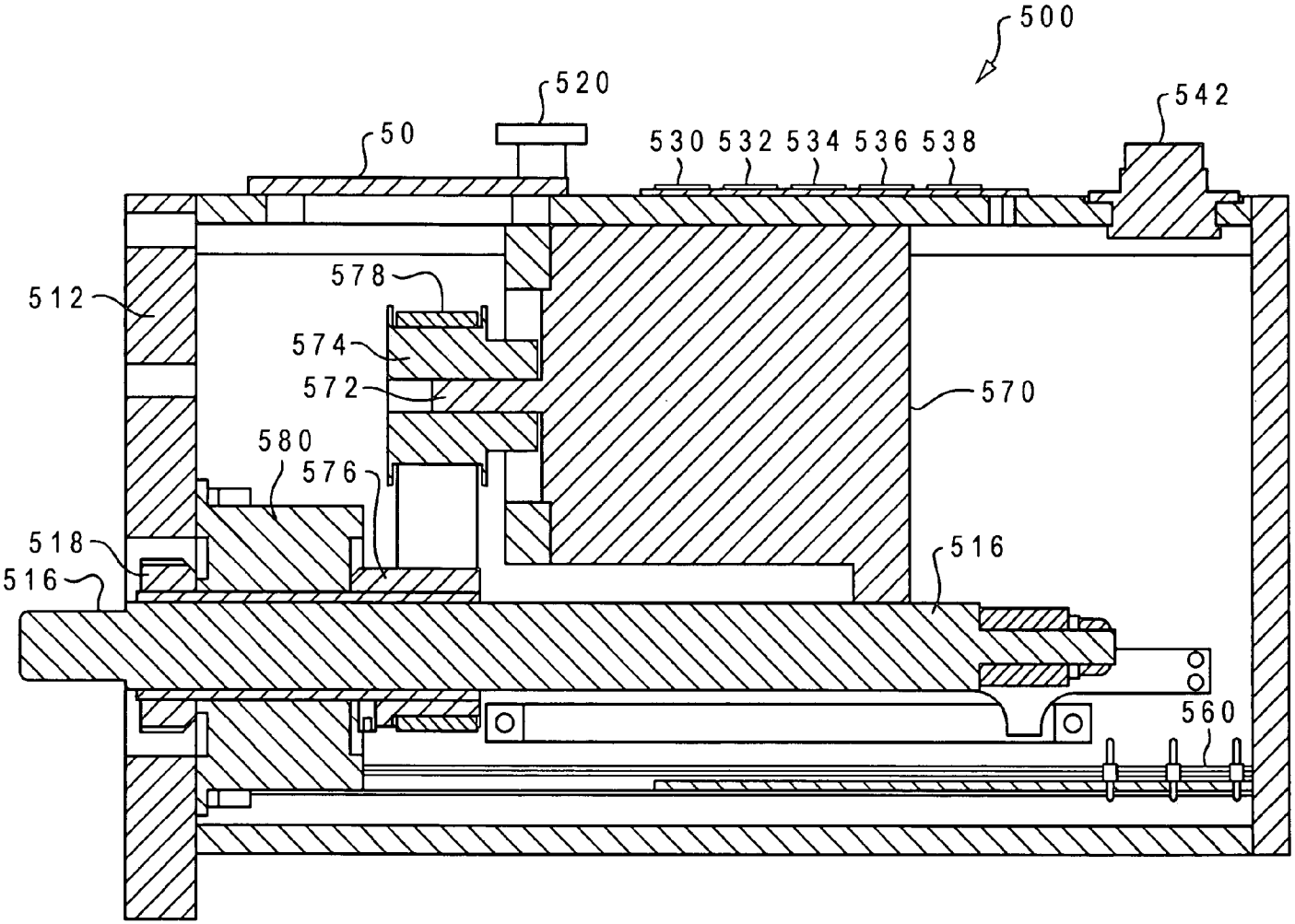
FIG. 16 is a section view of a second exemplary embodiment of a motor pack for an automated tool.

Referring now to FIG. 16, there is depicted a section view of a second exemplary embodiment of motor pack 500 taken along line A—A of FIG. 14. As is apparent upon inspection, the second embodiment shown in FIG. 16 differs from the first embodiment shown in FIG. 15 primarily in the arrangement of motor 570 and lead screw 516. In particular, motor 570 has an axis parallel to, but offset from the axis of lead screw 516.

Motor 570 has a motor shaft 572 on which a motor sprocket 574 is fixedly mounted for joint rotation with motor shaft 572. The exterior surface of motor sprocket 574, which may be toothed as illustrated in FIG. 9, engages a drive belt 578, which in turn rotates a screw sprocket 576. Screw sprocket 576 (which like motor sprocket 574 may have a toothed outer surface) has internal threads that engage corresponding threads of lead screw 516. Thus, rotation of screw sprocket 576 by drive belt 578 advances or retreats lead screw 516, depending on the direction of rotation of motor shaft 572 and motor sprocket 574. A bearing 580 through which lead screw 516 also passes further supports lead screw 516.

Figure 17:
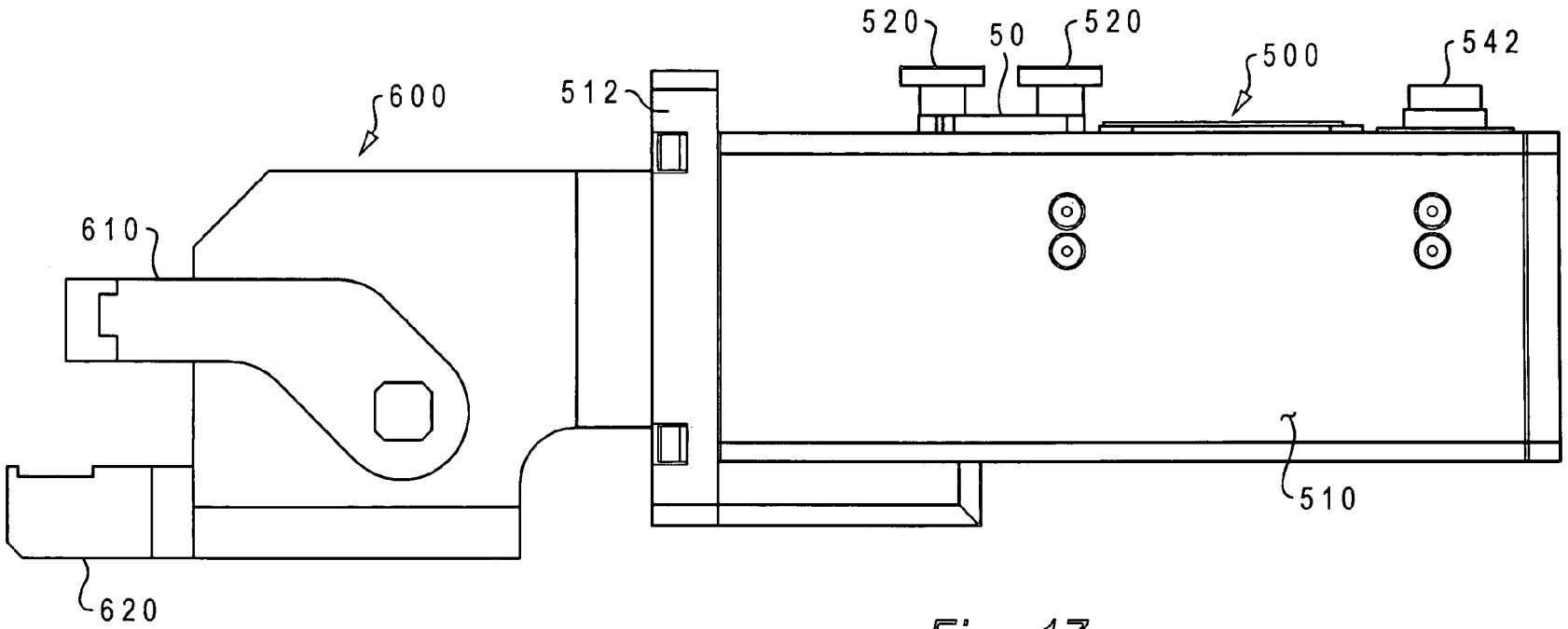
FIG. 17 is a side view of an automated gripper tool including a motor pack coupled to a gripper tool head.
Figure 18:
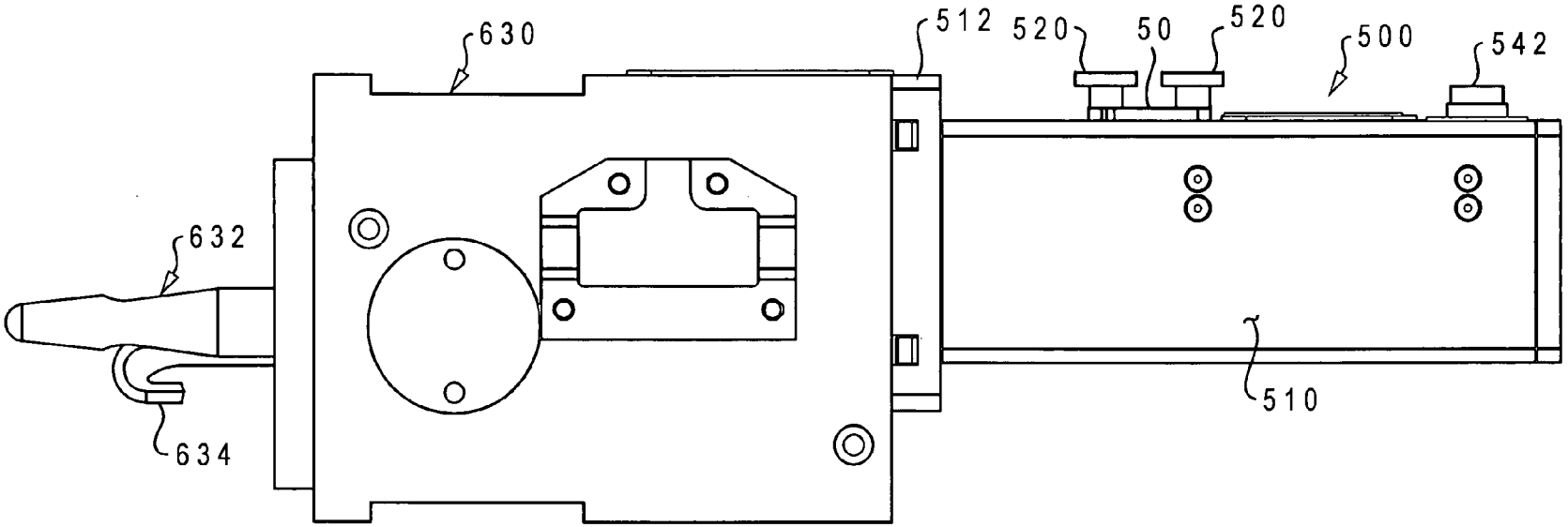
FIG. 18 is a side view of an automated pin clamp tool including a motor pack coupled to a pin clamp head.

As has been noted above, a motor pack 500 in accordance with the present invention may be utilized to drive multiple different tool heads, and may further be utilized to drive tool heads originally designed to be pneumatically driven. For example, in addition to the clamp heads described above, a motor pack 500 may be coupled to gripper head 600 to drive a movable jaw 610 toward and away from a fixed jaw 620, as depicted in FIG. 17. In addition, as illustrated in FIG. 18, motor pack 500 may be coupled to a pin clamp head 630 to linearly advance and retreat a pin 632. As understood by those skilled in the art, to clamp a work piece, pin 632 is typically advanced through a hole in the work piece. When pin 632 is subsequently retreated, hook 634 on pin 632 engages the work piece and draws the work piece to a clamped position.

The electrically powered tools described herein offer many advantages over the prior art. Housing the electrical circuitry controlling an electrically powered tool internally within the tool is a significant advantage. In addition, incorporating the electrical control circuitry and motor within a removable motor pack enables a single motor pack design to be utilized in conjunction with multiple different tool heads, thus significantly lowering development time and tool cost. Using two motors in tandem is a new and useful arrangement for making a more powerful electrically powered tool (e.g., electric clamp) while staying within industry size standards. The remote control provided by the optional remote pendant is another novel advantage, as is the ability to drive electrically powered tool with power supplied through the remote pendant when normal power is unavailable. The use of an encoder rather than limit switches allows for more intelligent, and more easily modified control. Being able to manually move the electrically powered tool using the thumb wheel allows for quick remedy for stuck condition or defective control condition. The ability to program terminal positions (e.g., clamped and unclamped positions) utilizing simple inputs is new and useful, as is the ability to use software to command the electrically powered tool to stop when an unrecoverable stuck condition is sensed. The electrically powered tool allows for automatic learning of programmed terminal positions, and allows a user to fine tune those positions, if desired.

While the invention has been particularly shown and described with reference to various preferred and alternative embodiments, it will be understood by those skilled in the art that various changes in form and detail may be made therein without departing from the spirit and scope of the invention.

What is claimed is:

1. A motor pack for an electrically driven tool, said motor pack comprising:

at least one electric motor;

a linearly displaceable member coupled to the at least one electric motor such that said linearly displaceable member is displaced axially by operation of the at least one electric motor, a housing enclosing the at least one electric motor and at least partially enclosing the linearly displaceable member, said housing including a front plate including attachment means for removably coupling a housing of a tool head abutting said front plate, said front plate having an aperture formed therein through which said linearly displaceable member is removably coupled to a moveable element in the tool head; and tool control circuitry enclosed within the housing and electrically coupled to the at least one electric motor to control operation of the at least one electric motor.

2. The motor pack of claim 1, wherein said linearly displaceable member comprises a lead screw extending axially through said at least one electric motor.

3. The motor pack of claim 1, wherein said linearly displaceable member extends from said housing through said aperture in said front plate.

4. The motor pack of claim 1, and further comprising a manual input device at an exterior of said housing for entry of tool commands, wherein said manual input device is electrically coupled to said tool control circuitry, and wherein said tool control circuitry, responsive to entry of a tool command utilizing said manual input device, operates said at least one electric motor to linearly displace said linearly displaceable member.

5. The motor pack of claim 4, wherein said manual input device comprises at least one manually actuated button.

6. The motor pack of claim 1, and further comprising a manual input device at an exterior of said housing electrically coupled to said tool control circuitry, wherein said tool control circuitry, responsive to entry of a teach command at said manual input device, memorizes a terminal position of said linearly displaceable member.

7. The motor pack of claim 1, wherein said linearly displaceable member comprises a threaded lead screw, and wherein said motor pack further comprises:

a first sprocket coupled to said at least one electric motor for rotation therewith;

a second sprocket spaced apart from said first sprocket, said second sprocket having a threaded through hole through which said lead screw passes;

a drive belt coupling said first and second sprockets, such that rotation of said first sprocket by said at least one electric motor rotates said second sprocket and axially displaces said lead screw.

8. The motor pack of claim 7, and further comprising a bearing supporting the lead screw.

9. A motor pack for an electrically driven tool said motor pack comprising:

an electric motor, a lead screw extending axially through and coupled to the electric motor such that the lead screw is displaced axially by operation of the electric motor, a housing enclosing the electric motor and at least partially enclosing the lead screw, said housing including a front plate to which a tool head may be removably coupled, said front plate having an aperture formed therein through which said lead screw is removably coupled to a moveable element in the tool head; and tool control circuitry enclosed within the housing and electrically coupled to the electric motor to control operation of the electric motor.

10. The motor pack of claim 9, wherein said lead screw extends from said housing through said aperture in said front plate.

11. The motor pack of claim 9, said front plate further comprising attachment means for coupling the tool head to said housing.

12. The motor pack of claim 9, and further comprising a manual input device at an exterior of said housing for entry of tool commands, wherein said manual input device is electrically coupled to said tool control circuitry, and wherein said tool control circuitry, responsive to entry of a tool command utilizing said manual input device, operates said at least one electric motor to axially displace said lead screw.

13. The motor pack of claim 12, wherein said manual input device comprises at least one manually actuated button.

14. The motor pack of claim 9, and further comprising a manual input device at an exterior of said housing electrically coupled to said tool control circuitry, wherein said tool control circuitry, responsive to entry of a teach command at said manual input device, memorizes a terminal position of said lead screw.

15. A motor pack for an electrically driven tool, said motor pack comprising:

at least one electric motor;

a first sprocket coupled to said at least one electric motor for rotation therewith;

a treaded lead screw;

a second sprocket spaced apart from said first sprocket, said second sprocket having a threaded through hole engaging threads of said threaded lead screw;

a drive belt coupling said first and second sprockets, such that rotation of said first sprocket by said at least one electric motor rotates said second sprocket and axially displaces said lead screw;

a housing enclosing the first and second sprockets, said drive belt, said at least one electric motor, and at least partially enclosing the lead screw, said housing including a front plate to which a tool head may be removably coupled, said front plate having an aperture formed therein through which said lead screw can be coupled to a moveable element in the tool head; and tool control circuitry enclosed within the housing and electrically coupled to the at least one electric motor to control operation of the at least one electric motor.

16. The motor pack of claim 15, wherein said lead screw extends from said housing through said aperture in said front plate.

17. The motor pack of claim 15, and further comprising a manual input device at an exterior of said housing for entry of tool commands, wherein said manual input device is electrically coupled to said tool control circuitry, and wherein said tool control circuitry, responsive to entry of a tool command utilizing said manual input device, operates said at least one electric motor to linearly displace said lead screw.

18. The motor pack of claim 17, wherein said manual input device comprises at least one manually actuated button.

19. The motor pack of claim 15, and further comprising a manual input device at an exterior of said housing electrically coupled to said tool control circuitry, wherein said tool control circuitry, responsive to entry of a teach command at said manual input device, memorizes a terminal position of said lead screw.

* * * * *